US006905020B2

(12) United States Patent
Chang

(10) Patent No.: US 6,905,020 B2
(45) Date of Patent: Jun. 14, 2005

(54) TOOL ORGANIZER HAVING ROTATABLE TOOL HOLDERS

(76) Inventor: Yu Wei Chang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/645,680

(22) Filed: Aug. 19, 2003

(65) Prior Publication Data

US 2005/0040062 A1 Feb. 24, 2005

(51) Int. Cl.[7] ..... B65D 85/28
(52) U.S. Cl. ..... 206/373; 206/349; 206/766
(58) Field of Search ..... 206/349, 372–378, 206/234, 731, 759, 766; 211/71.01, 85.18, 85.21, 78, 85.1

(56) References Cited

U.S. PATENT DOCUMENTS

| | | | | | |
|---|---|---|---|---|---|
| 3,931,894 | A | * | 1/1976 | Murphy | 211/163 |
| 4,126,366 | A | * | 11/1978 | Handler et al. | 211/163 |
| 4,285,556 | A | | 8/1981 | Loeffel | 312/244 |
| 4,768,651 | A | | 9/1988 | Lanius | 206/315.11 |
| 5,114,007 | A | | 5/1992 | Chen | 206/373 |
| 5,378,005 | A | | 1/1995 | Norton | 280/47.26 |
| 5,547,098 | A | * | 8/1996 | Jordan | 206/373 |
| 5,915,554 | A | * | 6/1999 | Hung | 206/372 |
| D426,062 | S | * | 6/2000 | Shui-Shang | D3/315 |
| 6,105,768 | A | * | 8/2000 | Brown | 206/373 |
| 6,390,298 | B1 | * | 5/2002 | Garro | 206/378 |
| 2004/0182730 | A1 | * | 9/2004 | Lee | 206/349 |
| 2004/0188293 | A1 | * | 9/2004 | Lee | 206/349 |

* cited by examiner

*Primary Examiner*—Mickey Yu
*Assistant Examiner*—J. Gregory Pickett
(74) *Attorney, Agent, or Firm*—Charles E. Baxley

(57) ABSTRACT

A tool organizer includes a housing and one or more tool holders each having a middle axle rotatably engaged with the upper and the bottom plates, to stably and rotatably secure the tool holders between the upper and the bottom plates. Each of the tool holders includes a number of recesses to receive tool elements. A number of posts are secured between the upper and the bottom plates, and each includes two ends engaged into the lock channels of the upper and the bottom plates. A container may be received in the housing to retain tool elements. The housing may be rotatably secured on a base with a shaft and ball bearings.

17 Claims, 5 Drawing Sheets

TOOL ORGANIZER HAVING ROTATABLE TOOL HOLDERS

BACKGROUND OF THE INVENTION

1. Field of the Invention

The present invention relates to a tool organizer, and more particularly to a tool organizer having one or more tool holder members for displaying and/or storing tool elements.

2. Description of the Prior Art

Various kinds of typical tool organizers have been developed for receiving and/or storing tool elements, and comprise a number of chambers or compartments provided therein for receiving different tool elements.

For example, U.S. Pat. No. 4,768,651 to Lanius discloses one of the typical tool organizers having a number of compartments provided therein and formed by wall or partition members, and one or more drawers for receiving different tool elements. However, it will be difficult to display or show the tool elements for the public or for customers.

U.S. Pat. No. 4,285,556 to Loeffel, U.S. Pat. No. 5,114,007 to Chen, and U.S. Pat. No. 5,378,005 to Norton disclose the other three of the typical tool organizers having one or more foldable door panels or cover panels, and a number of compartments provided therein and formed by wall or partition members, and one or more drawers for receiving different tool elements. However, it will be difficult to display or show the tool elements for the public or for customers. In addition, the tool organizers may not be assembled by the users themselves.

The present invention has arisen to mitigate and/or obviate the afore-described disadvantages of the conventional tool organizers.

SUMMARY OF THE INVENTION

The primary objective of the present invention is to provide a tool organizer including one or more tool holder members having central or intermediate rotating axle for rotatably securing or attaching the tool holder members to the tool organizer, and for allowing various tool elements to be displayed and/or stored within the tool holder members.

In accordance with one aspect of the invention, there is provided a tool organizer comprising a housing including an upper plate and a bottom plate, and at least one tool holder including two sides, and a middle axle provided between the two sides thereof and rotatably engaged with the upper and the bottom plates, to stably and rotatably secure the tool holder between the upper and the bottom plates, and the tool holder including a plurality of recesses formed therein for receiving tool elements.

The housing includes a plurality of posts secured between the upper and the bottom plates. Each of the upper and the bottom plates includes a plurality of lock channels formed therein, each of the posts includes two ends engaged into the lock channels of the upper and the bottom plates respectively.

Each of the upper and the bottom plates includes at least one catch extended into each of the lock channels thereof and engageable into the posts respectively, to secure the posts to the upper and the bottom plates. Each of the posts includes at least one lock depression formed therein to receive the catch of the bottom and the upper plates, and to secure the posts to the upper and the bottom plates. Each of the posts includes two curved side surfaces to allow the tool holders to be suitably retained between the posts.

A container may further be provided and received in the housing. The housing includes a bore formed in the upper plate to receive the container into the housing. The upper plate includes at least one lock notch formed therein, the container includes at least one projection extended outwardly therefrom, to engage into the lock notch of the upper plate, and to detachably retain the container in the housing.

The container includes a lock slot formed in the projection thereof, and further includes a cover having at least one tongue extended outwardly therefrom, to engage into the lock slot of the container, and to detachably retain the cover to the container.

A cover may further be provided and engageable onto the container, to enclose the container. A base may further be provided and to rotatably secure the housing thereon with a shaft. The base includes a plurality of ball bearings provided thereon and engaged with the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
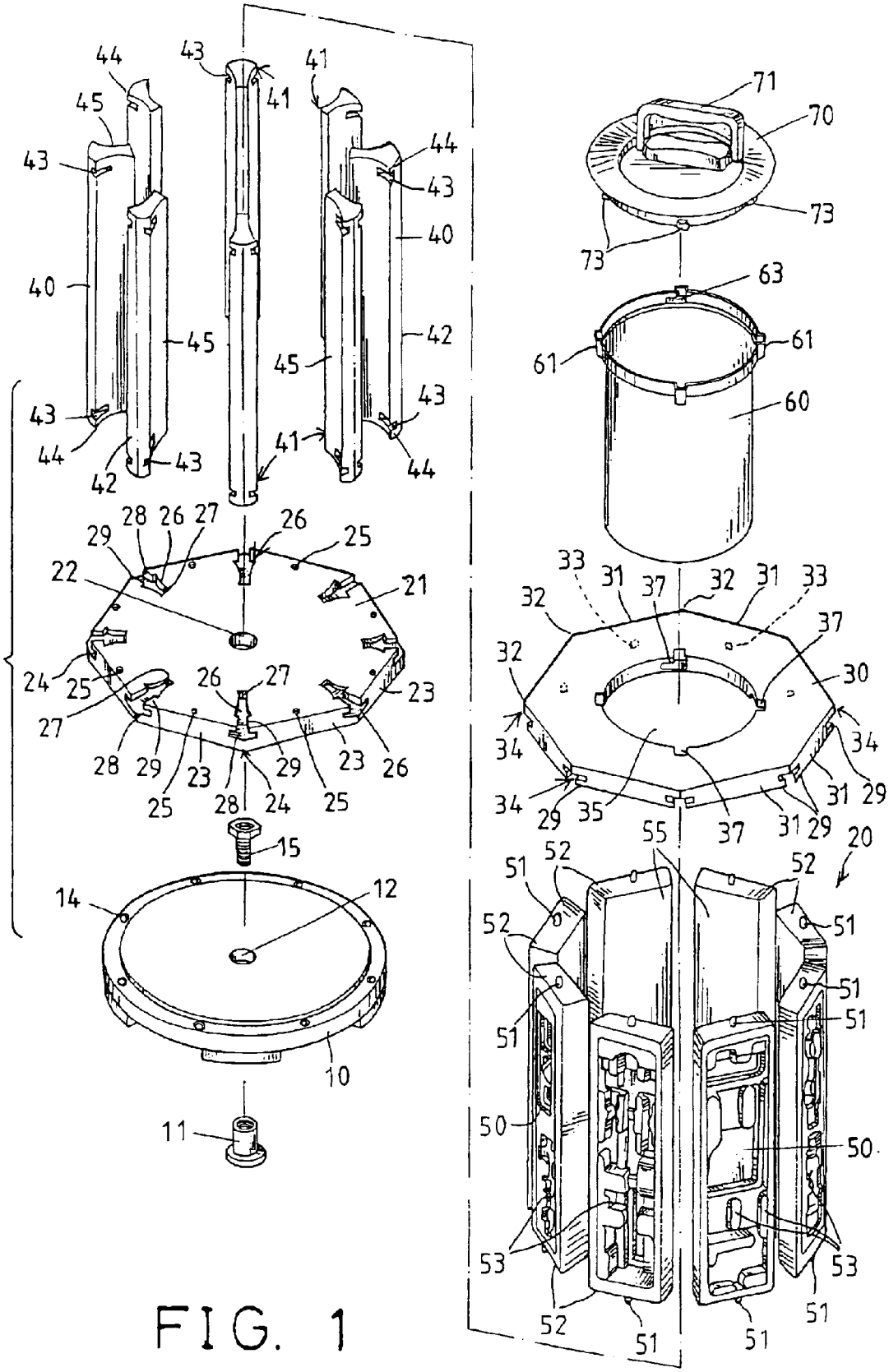
FIG. 1 is an exploded view of a tool organizer in accordance with the present invention.
Figure 2:
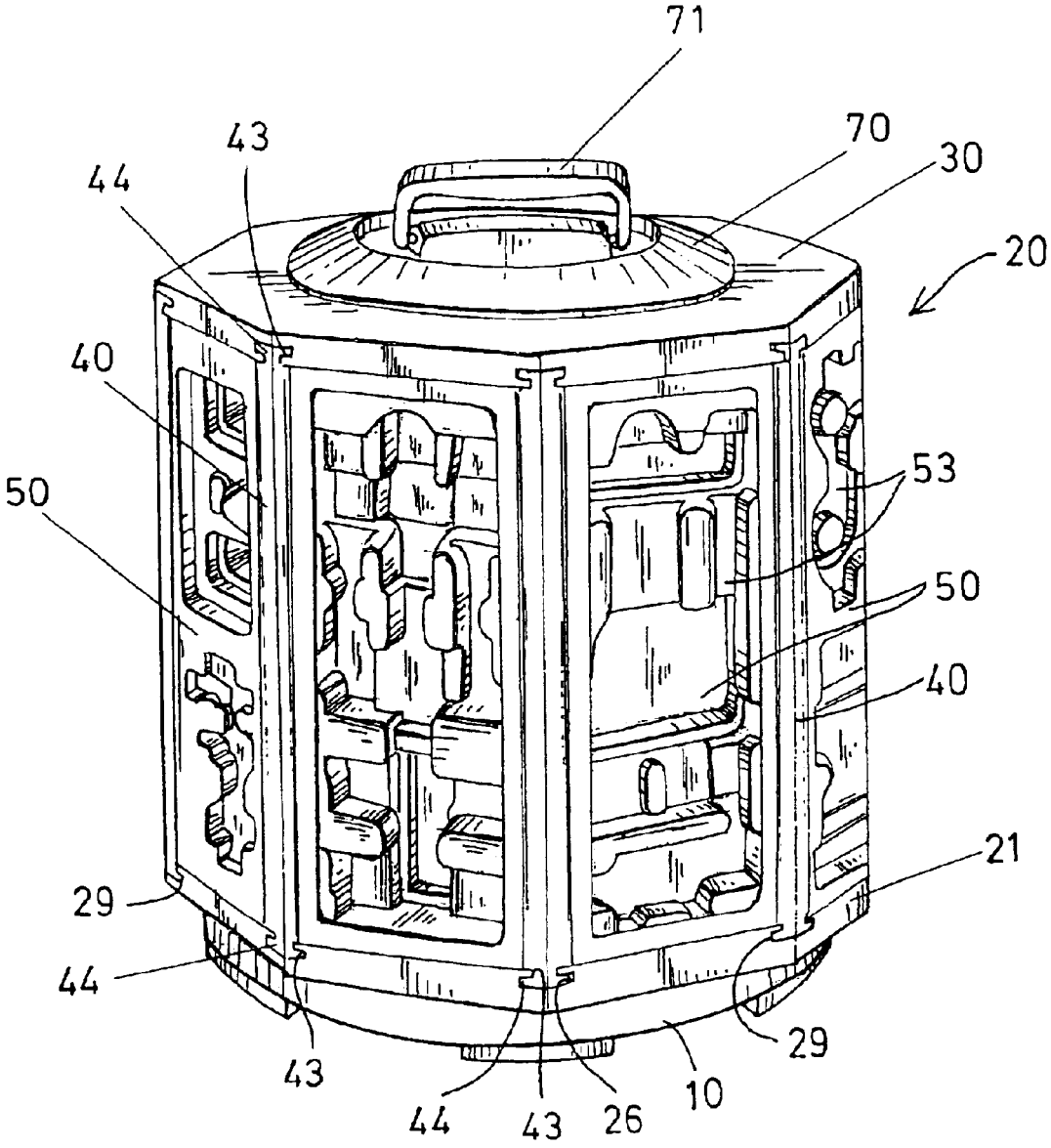
FIG. 2 is a perspective view of the tool organizer.

Referring to the drawings, and initially to FIGS. 1–4, a tool organizer in accordance with the present invention comprises a housing 20 to be pivotally or rotatably secured to a base 10 with such as a hub or shaft 11. The base 10 includes a hole 12 formed in the central portion thereof for receiving the hub or shaft 11 therein, and a number of balls or ball bearings 14 disposed on the upper and outer peripheral portion of the base 10.

The housing 20 includes a bottom plate 21, an upper plate 30, and a number of posts 40 to be secured between the bottom plate 21 and the upper plate 30. The bottom plate 21 includes a hole 22 formed in the central portion thereof for receiving the shaft 11 therein, and thus for pivotally or rotatably securing the bottom plate 21 of the housing 20 to the base 10.

A fastener 15 may engage through the hole 22 of the bottom plate 21 and may be threaded or secured to the shaft 11, to rotatably secure the bottom plate 21 to the base 10 with the shaft 11. The balls or ball bearings 14 of the base 10 are engaged with the bottom plate 21, for smoothly and stably and rotatably support the bottom plate 21 on top of the base 10.

The bottom plate 21 and the upper plate 30 preferably include a polygonal structure or shape each having three or more, such as eight, sides 23, 31 and three or more, such as eight, corners 24, 32 formed or defined between the sides 23, 31 of the bottom plate 21 and the upper plate 30 respectively.

Each of the bottom plate 21 and the upper plate 30 preferably includes a number of cavities 25, 33 formed in the outer peripheral portion thereof and close to the sides 23, 31 thereof respectively, and preferably arranged in the middle or center portion of the sides 23, 31 thereof respectively. The upper plate 30 includes a bore 35 formed in the inner or center portion thereof, and one or more lock notches 37 formed in the inner peripheral portion thereof and communicating with the bore 35 of the upper plate 30.

Each of the bottom plate 21 and the upper plate 30 preferably includes a number of lock channels 26, 34 formed in the corners 24, 32 thereof respectively, and each having a narrower inner end 27 and a wider outer end 28, and one or more catches 29 extended into the lock channels 26, 34 from the wider outer ends 28 thereof respectively, best shown in FIG. 1.

Each of the posts 40 includes an upper and a bottom ends 41 engageable into the lock channels 26, 34 of the bottom and the upper plates 21, 30, and includes a wider outer portion 42 for engaging in the wider outer ends 28 of the lock channels 26, 34 of the bottom and the upper plates 21, 30, and includes one or more lock depressions 43 formed in either of the upper or the bottom end 41 thereof each to define a lock ear 44 and each to receive a respective catch 29 of the bottom and the upper plates 21, 30.

Figure 5:
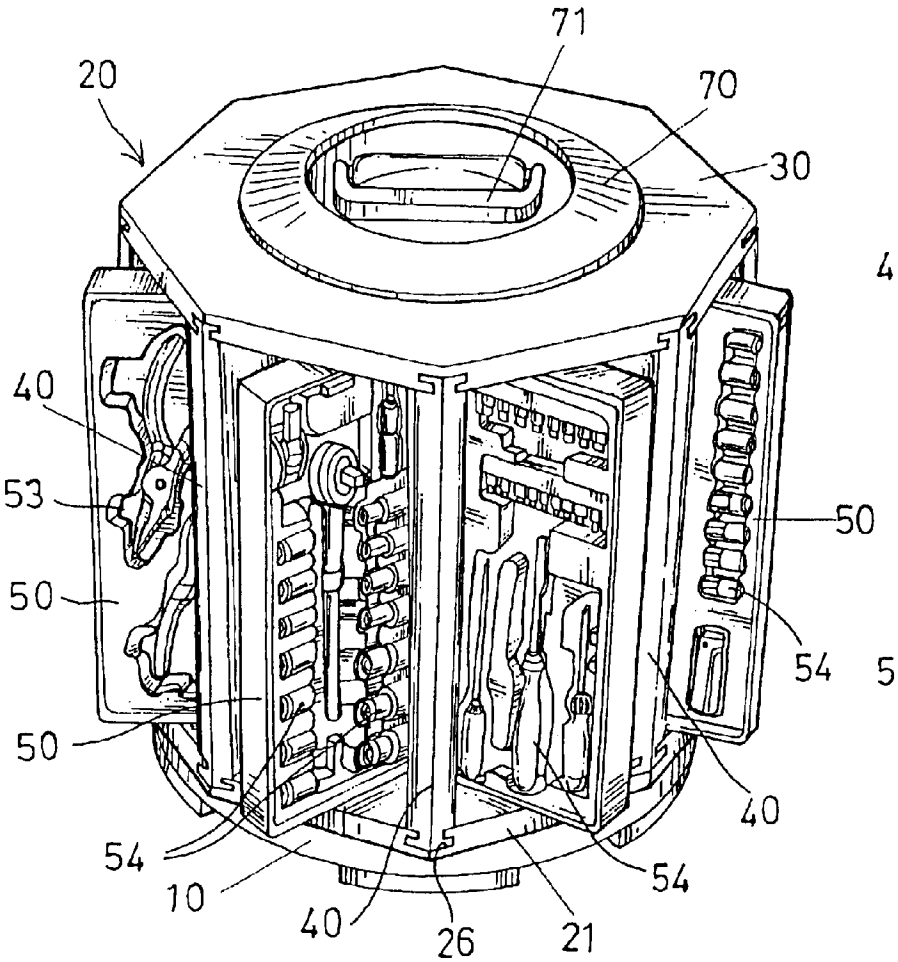

In assembling, as shown in FIGS. 1, 5, the upper and the bottom ends 41 of the posts 40 may be engaged into the lock channels 26, 34 of the bottom and the upper plates 21, 30, and the catches 29 of the bottom and the upper plates 21, 30 may be engaged into the lock depressions 43 of the posts 40 by such as force-fitted engagements, adhesive materials, or by welding processes, such that the bottom and the upper plates 21, 30 may be secured together with the posts 40.

A number of tool holders 50 each includes a middle axle 51 provided between two sides 52 thereof, or extended upwardly and/or downwardly therefrom to rotatably engage into the respective cavities 25, 33 of the bottom and the upper plates 21, 30, and thus to rotatably secure the tool holders 50 in the housing 20, or between the bottom and the upper plates 21, 30. The tool holders 50 may thus be rotatably secured in the housing 20 or between the bottom and the upper plates 21, 30 with the middle axles 51 thereof.

Figure 4:
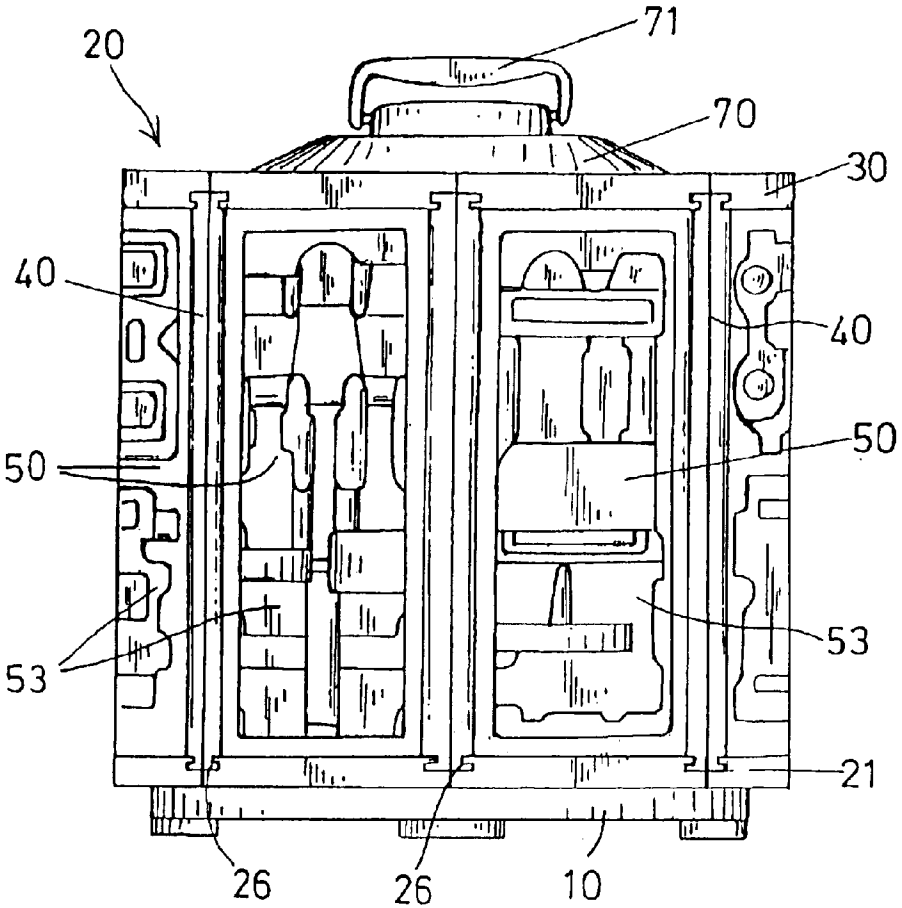
FIG. 4 is a front plan schematic view of the tool organizer.
Figure 3:
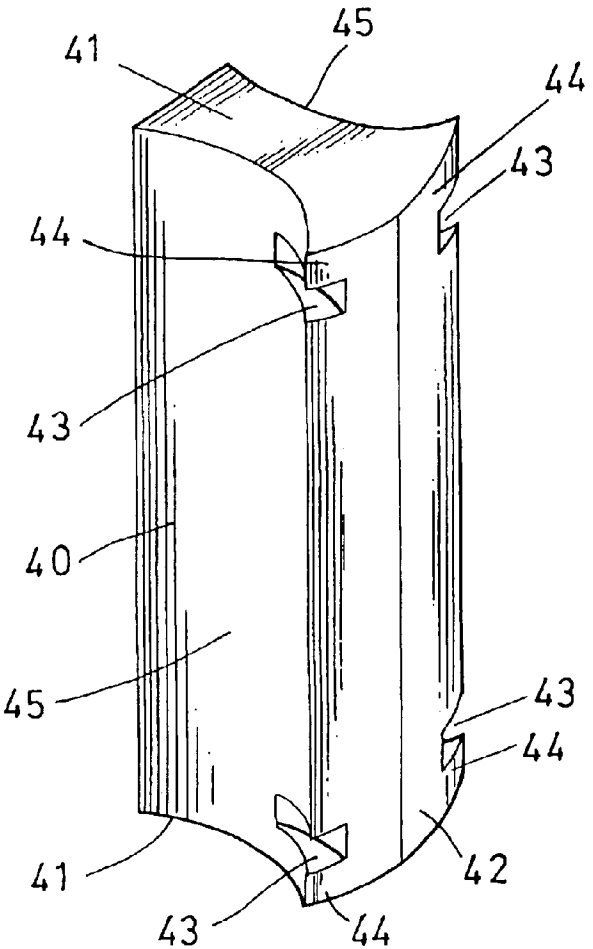
FIG. 3 is an enlarged perspective view of a post for a housing of the tool organizer.
Figure 6:
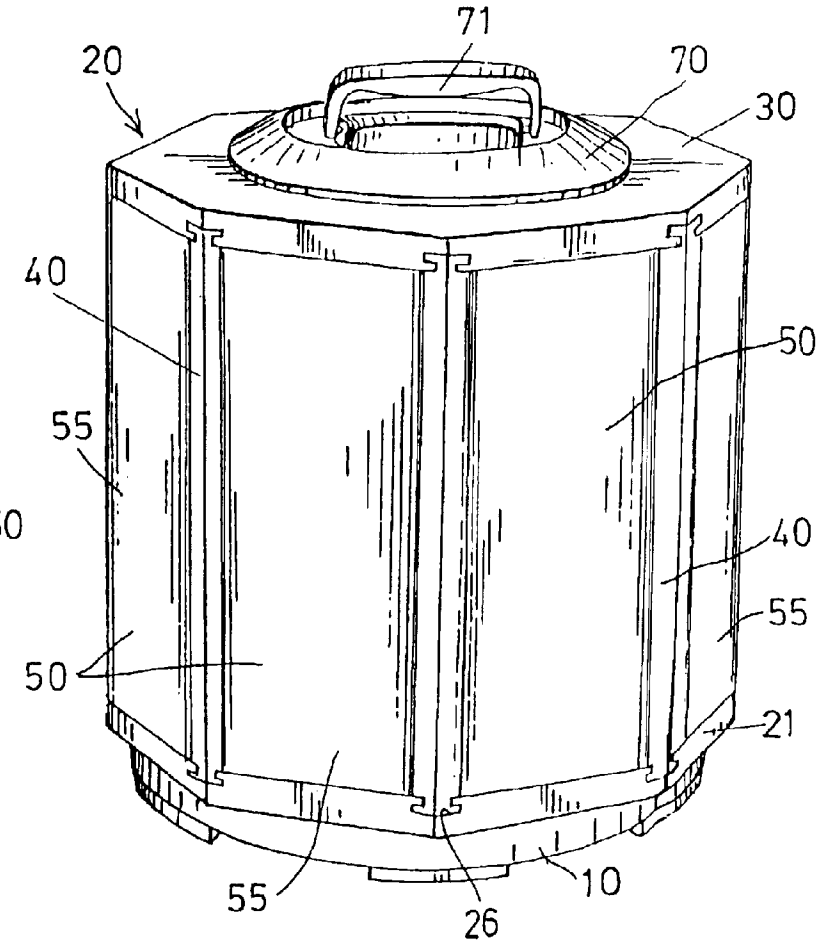
FIGS. 5, 6 are perspective views illustrating the operation of the tool organizer.

Each of the tool holders 50 includes a number of recesses 53 formed in one side thereof (FIGS. 1, 2, 4) to receive various tool elements 54 (FIG. 5), and includes a flat outer side 55 (FIGS. 1, 6) formed or located opposite to the recesses 53 thereof. The tool elements 54 or the recesses 53 and the flat outer sides 55 of the tool holders 50 may thus be selectively rotated and faced outwardly (FIGS. 4–6). As best shown in FIGS. 1 and 3, each of the posts 40 includes two curved side surfaces 45, for allowing the tool holders 50 to be suitably retained between the posts 40, and to be suitably rotated relative to the bottom and the upper plates 21, 30 of the housing 20.

It is to be noted that the tool holders 50 may be rotatably secured in the housing 20 or between the bottom and the upper plates 21, 30 with the middle axles 51 which are preferably located in the geometric center or the center of gravity of the tool holders 50 respectively, such that the tool holders 50 may be stably supported between the bottom and the upper plates 21, 30 of the housing 20, to rotate the tool elements 54 inward or outward of the housing 20. The conventional tool organizers fail to provide one or more tool holders 50 having a middle portion rotatably secured between two plates 21, 30 to stably support tool elements 54.

A container 60 may further be provided and engageable into the housing 20 via the bore 35 of the upper plate 30, and includes one or more projections 61 extended outwardly therefrom, to engage into the corresponding lock notches 37 of the upper plate 30, and to detachably retain the container 60 in the housing 20. The container 60 includes a lock slot 63 formed in each of the projections 61 thereof. The container 60 may also be used to receive or store various tool elements 54 therein.

Figure 7:
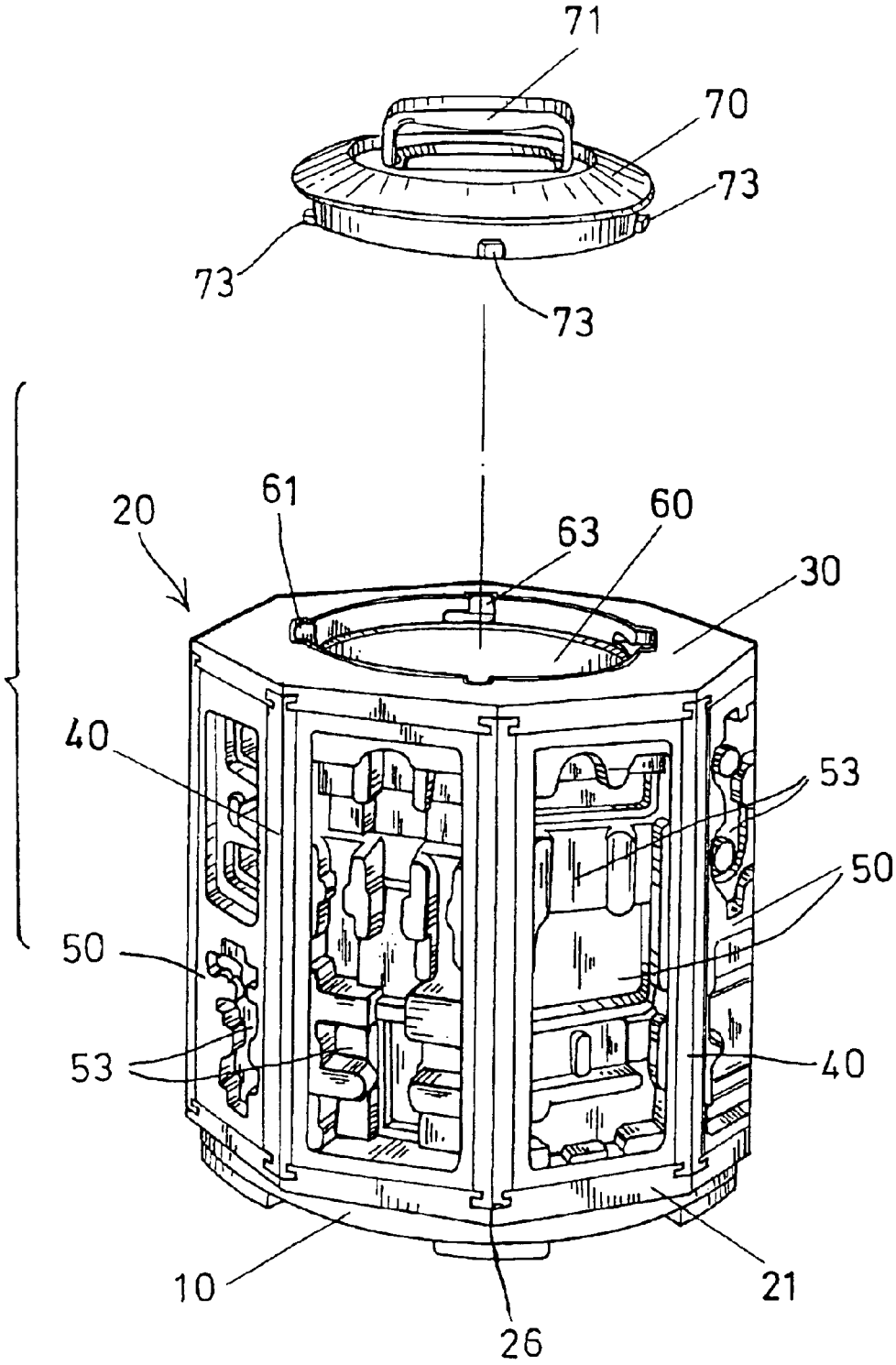
FIG. 7 is a partial exploded view illustrating the operation of a container of the tool organizer.

A cover 70 includes a handle 71 provided on top thereof for carrying purposes, and includes one or more tongues 73 extended outwardly therefrom (FIGS. 1, 7), to engage into the corresponding lock slots 63 of the container 60, and to detachably secure the cover 70 to the container 60, and thus to the housing 20. The cover 70 may be used to retain the tool elements 54 in the container 60.

Accordingly, the tool organizer in accordance with the present invention includes one or more tool holder members having central or intermediate rotating axle for rotatably securing or attaching the tool holder members to the tool organizer, and for allowing various tool elements to be displayed and/or stored within the tool holder members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool organizer comprising:

a housing including an upper plate and a bottom plate, each of said upper and said bottom plates including a plurality of lock channels formed therein, and said housing including a plurality of posts secured between said upper and said bottom plates, each of said posts including two ends engaged into said lock channels of said upper and said bottom plates respectively, and at least one tool holder including two sides, and a middle axle provided between said two sides thereof and rotatably engaged with said upper and said bottom plates, to rotatably secure said at least one tool holder between said upper and said bottom plates, and said at least one tool holder including a plurality of recesses formed therein for receiving tool elements.

2. The tool organizer as claimed in claim 1, wherein each of said upper and said bottom plates includes at least one catch extended into each of said lock channels thereof and engageable into said posts respectively, to secure said posts to said upper and said bottom plates.

3. The tool organizer as claimed in claim 2, wherein each of said posts includes at least one lock depression formed therein to receive said at least one catch of said bottom and said upper plates, and to secure said posts to said upper and said bottom plates.

4. The tool organizer as claimed in claim 1 further comprising a container received in said housing.

5. The tool organizer as claimed in claim 4, wherein said housing includes a bore formed in said upper plate to receive said container into said housing.

6. The tool organizer as claimed in claim 4 further comprising a cover engageable and attachable onto said container, to enclose said container.

7. The tool organizer as claimed in claim 1 further comprising a base, said housing being rotatably secured on said base with a shaft.

8. The tool organizer as claimed in claim 7, wherein said base includes a plurality of ball bearings provided thereon and engaged with said housing, to smoothly and stably support said housing on said base.

9. A tool organizer comprising:

a housing including an upper plate and a bottom plate, said upper plate including at least one lock notch formed therein, at least one tool holder including two sides, and a middle axle provided between said two sides thereof and rotatable engaged with said upper and said bottom plates, to rotatable secure said at least one tool holder between said upper and said bottom plates, said at least one tool holder including a plurality of recesses formed therein for receiving tool elements, a container received in said housing, said housing including a bore formed in said upper plate to receive said container into said housing, and said container including at least one projection extended outwardly therefrom, to engage into said at least one lock notch of said upper plate, and to detachably retain said container in said housing.

10. The tool organizer as claimed in claim 9, wherein said container includes a lock slot formed in said at least one projection thereof, and further includes a cover having at least one tongue extended outwardly therefrom, to engage into said lock slot of said container, and to detachably retain said cover to said container.

11. A tool organizer comprising:

a housing including an upper plate and a bottom plate, and including a plurality of posts secured between said upper and said bottom plates, at least one tool holder including two sides, and a middle axle provided between said two sides thereof and rotatable engaged with said upper and said bottom plates, to rotatably secure said at least one tool holder between said upper and said bottom plates, said at least one tool holder including a plurality of recesses formed therein for receiving tool elements, and each of said posts including two curved side surfaces to allow said at least one tool holder to be suitably retained between said posts.

12. A tool organizer comprising:

a housing including an upper plate and a bottom plate, each of said upper and said bottom plates including a plurality of lock channels formed therein, at least one tool holder rotatably secured between said upper and said bottom plates, and said at least one tool holder including two sides, and a middle axle provided between said two sides thereof and rotatably engaged with said upper and said bottom plates, to rotatably secure said at least one tool holder between said upper and said bottom plates, and a plurality of posts to be secured between said upper and said bottom plates, each of said posts including two ends engaged into said lock channels of said upper and said bottom plates respectively, and each of said upper and said bottom plates including at least one catch extended into each of said lock channels thereof and engageable into said posts respectively, to secure said posts to said upper and said bottom plates.

13. The tool organizer as claimed in claim 12, wherein each of said posts includes at least one lock depression formed therein to receive said at least one catch of said bottom and said upper plates, and to secure said posts to said upper and said bottom plates.

14. The tool organizer as claimed in claim 12, wherein each of said posts includes two curved side surfaces to allow said at least one tool holder to be suitably retained between said posts.

15. A tool organizer comprising:

a housing including an upper plate and a bottom plate, each of said upper and said bottom plates including a plurality of lock channels formed therein, at least one tool holder rotatably secured between said upper and said bottom plates, a plurality of posts to be secured between said upper and said bottom plates, each of said posts including two ends engaged into said lock channels of said upper and said bottom plates respectively, and each of said upper and said bottom plates including at least one catch extended into each of said lock channels thereof and engageable into said posts respectively, to secure said posts to said upper and said bottom plates, and a container received in said housing, said housing including a bore formed in said upper plate to receive said container into said housing.

16. The tool organizer as claimed in claim 15, wherein said upper plate includes at least one lock notch formed therein, said container includes at least one projection extended outwardly therefrom, to engage into said at least one lock notch of said upper plate, and to detachably retain said container in said housing.

17. The tool organizer as claimed in claim 16, wherein said container includes a lock slot formed in said at least one projection thereof, and further includes a cover having at least one tongue extended outwardly therefrom, to engage into said lock slot of said container, and to detachably retain said cover to said container.

* * * * *